US006089835A

United States Patent [19]

Suzuura et al.

[11] Patent Number: 6,089,835

[45] Date of Patent: Jul. 18, 2000

[54] PORTABLE COMPRESSOR

[75] Inventors: Tsukasa Suzuura; Mitsuo Ogura; Mitsuyuki Ishikawa; Toshifumi Kubota; Mitsuhiro Sunaoshi, all of Hitachinaka, Japan

[73] Assignee: Hitachi Koki Co., Ltd., Tokyo, Japan

[21] Appl. No.: 09/215,379

[22] Filed: Dec. 18, 1998

[30] Foreign Application Priority Data

Dec. 25, 1997 [JP] Japan ..... 9-357249
Mar. 31, 1998 [JP] Japan ..... 10-085362

[51] Int. Cl.[7] ..... F01B 17/00; F01B 35/04

[52] U.S. Cl. ..... 417/415; 417/360; 418/60

[58] Field of Search ..... 92/86; 417/415, 417/363, 53, 26, 313, 237, 360, 368; 227/130; 418/60

[56] References Cited

U.S. PATENT DOCUMENTS 3,836,290 9/1974 Carter ..... 417/415
3,849,028 11/1974 Kurita et al. ..... 417/363
3,947,160 3/1976 Black et al. ..... 418/60
4,063,853 12/1977 De Groat ..... 417/53
4,080,105 3/1978 Connell ..... 417/26
4,529,365 7/1985 Schutt et al. ..... 417/313
4,536,132 8/1985 Tenney ..... 417/237
4,615,259 10/1986 Anbe ..... 92/86
4,834,626 5/1989 Prevosto ..... 417/415
4,854,829 8/1989 Stanzani et al. ..... 417/360
5,137,434 8/1992 Wheeler et al. ..... 417/368
5,720,423 2/1998 Kondo et al. ..... 227/130
6,004,103 12/1999 Fisher et al. ..... 417/26

*Primary Examiner*—Teresa Walberg
*Assistant Examiner*—Leonid Fastovsky
*Attorney, Agent, or Firm*—Louis Woo

[57] ABSTRACT

A motor and a power transmitting mechanism are accommodated and supported in a two-piece housing unit separable into first and second housings. An air tank is defined by an outer surface of the second housing and an inside surface of a third housing provided on a recessed outer surface of the second housing.

12 Claims, 7 Drawing Sheets

PORTABLE COMPRESSOR

BACKGROUND OF THE INVENTION

The present invention relates to a portable compressor comprising a motor, a compression mechanism connected to the motor via a power transmitting mechanism and driven by the rotational force of the motor, and an air tank storing compression air produced by the compression mechanism.

The applicant has previously proposed a portable compressor (refer to Japanese Patent No. Sho 62-21998), according to which a motor and a power transmitting mechanism (collectively referred to as a driving mechanism) are in parallel with an air tank. The air tank and the driving mechanism are connected each other at one end via a compression mechanism, comprising a cylinder etc., and a connecting member such as a stay. Auxiliary devices or accessories, including a pressure-reducing valve and a pressure switch, are disposed in a space formed at the other end of the air tank and the driving mechanism.

In the arrangement for connecting the driving mechanism to the air tank disposed parallel to each other, the compression mechanism and the connecting member are located in a direction normal to the longitudinal axes of the driving mechanism and the air tank. This layout or arrangement is disadvantageous in realizing the downsizing of the compressor. Furthermore, for securely fixing the auxiliary devices to the air tank, it is necessary to weld the mounting parts, such as mounting eyes, on the outer surface of the air tank. This is not desirable in that the assembling of the compressor becomes very time consuming and the total number of compressor parts increases. The costs will be increased.

SUMMARY OF THE INVENTION

An object of the present invention is to provide a portable compressor compact in size, simple in arrangement, and low in manufacturing cost.

In order to accomplish this and other related objects, the present invention provides a portable compressor comprising a motor for generating a rotational force, a compression mechanism including a member driven by the rotational force transmitted from the motor via a power transmitting mechanism, and an air tank storing compression air produced by the compression mechanism. The motor and the power transmitting mechanism are accommodated and supported in a two-piece housing unit separable into first and second housings, and the air tank is defined by an outer surface of the second housing and an inside surface of a third housing provided on the second housing.

Preferably, the first to third housings are mold or cast products. The compression mechanism is located adjacent to the third housing. A top level of the compression mechanism is substantially the same as that of the third housing. A ring groove is formed along flanged peripheries of the second and third housings. A seal member is inserted into the ring groove. The second and third housings are airtightly fixed via the seal member by means of fastening members.

Preferably, the second housing has a recessed portion on the outer surface thereof, and the third housing is provided on the recessed portion of the second housing. The two-piece housing unit is separable along a plane including the axes of the motor and the a power transmitting mechanism. The power transmitting mechanism includes a drive shaft and an output shaft connected by an elastic element. A plurality of locating snap rings are provided for positioning the shafts of the power transmitting mechanism in a closed chamber accommodating the elastic member. The elastic element may be held by holders having a restricting mechanism for limiting an angular deviation between the drive shaft and the output shaft. The compression mechanism overhangs from the second housing, leaving a space available for locating the air tank.

Preferably, a mounting portion is integrally formed on an outer surface of the air tank for fixing auxiliary devices of the compressor. The auxiliary devices are disposed in a stepped portion of the two-piece housing unit formed due to an offset arrangement for locating gears in the power transmitting mechanism.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENT

Figure 1:
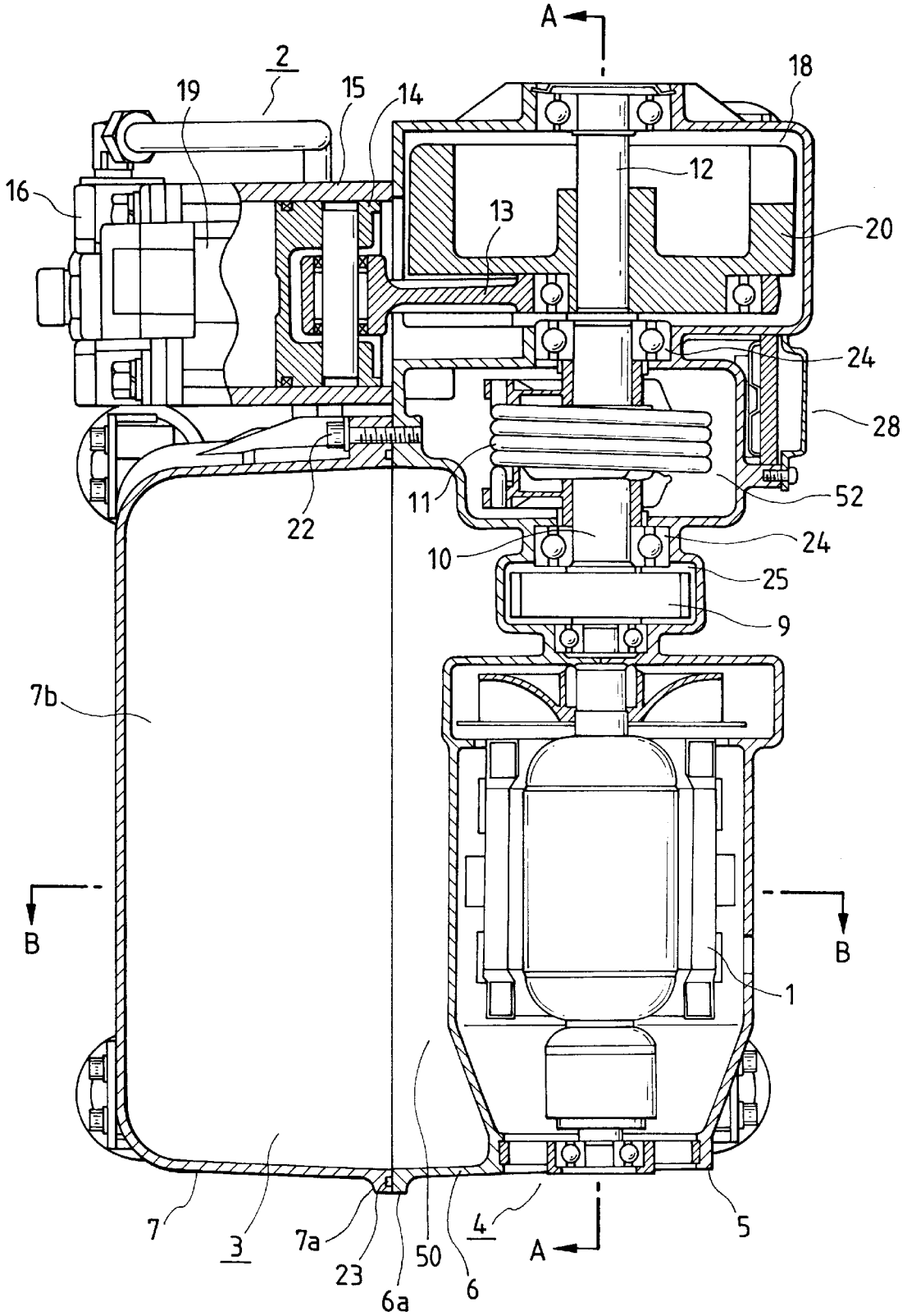
FIG. 1 is a cross-sectional view showing an arrangement of a portable compressor in accordance with a preferable embodiment of the present invention.
Figure 2:
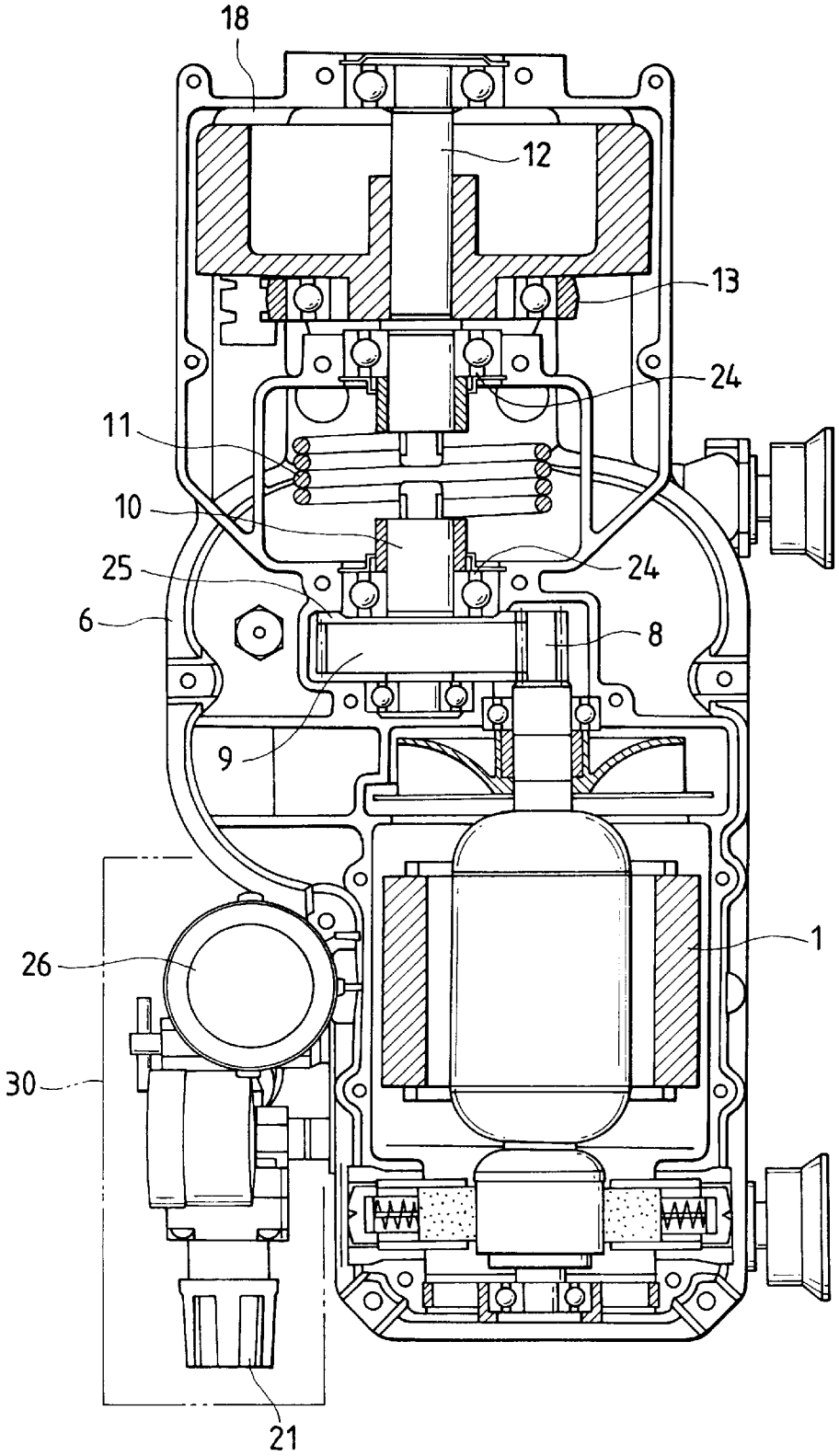
FIG. 2 is a cross-sectional view taken along a line A—A shown in FIG. 1.
Figure 3:
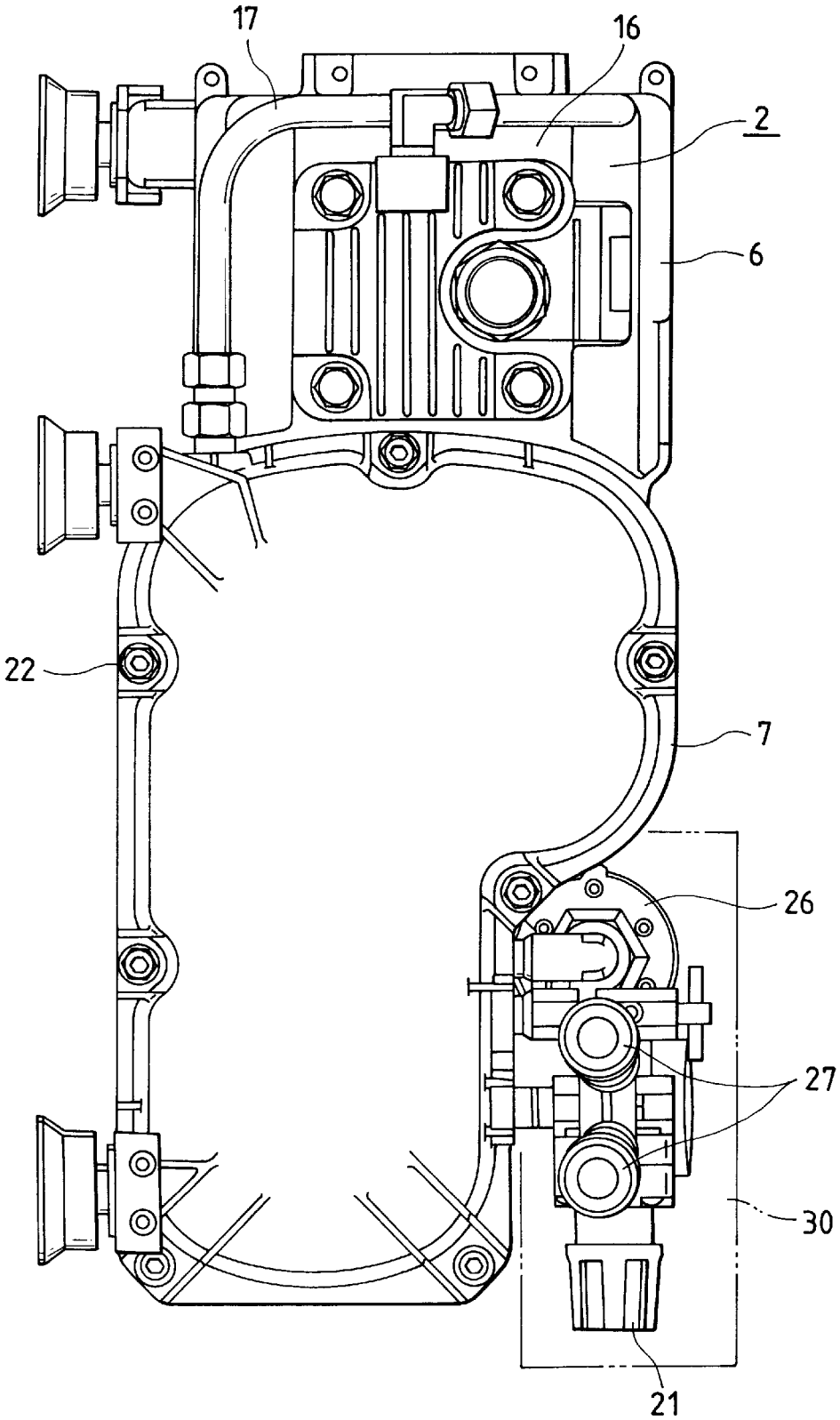
FIG. 3 is a side view showing the portable compressor shown in FIG. 1.

A preferred embodiment of the present invention will be explained with reference to the attached drawings.

A motor 1 generates a rotational force for driving a compressor. A pinion 8 is securely fixed to the output shaft of the motor 1. A gear 9 meshes with the pinion 8. Through the engagement of the pinion 8 and the gear 9, the rotational force of the motor 1 is transmitted to a drive shaft 10. Rotation of the drive shaft 10 is transmitted to an output shaft 12 via a coil spring 11. The output shaft 12 is connected to a piston 14 via a connecting rod 13 and, when rotating, causes the piston 14 to reciprocate in the axial direction of a cylinder 15.

Figure 4:
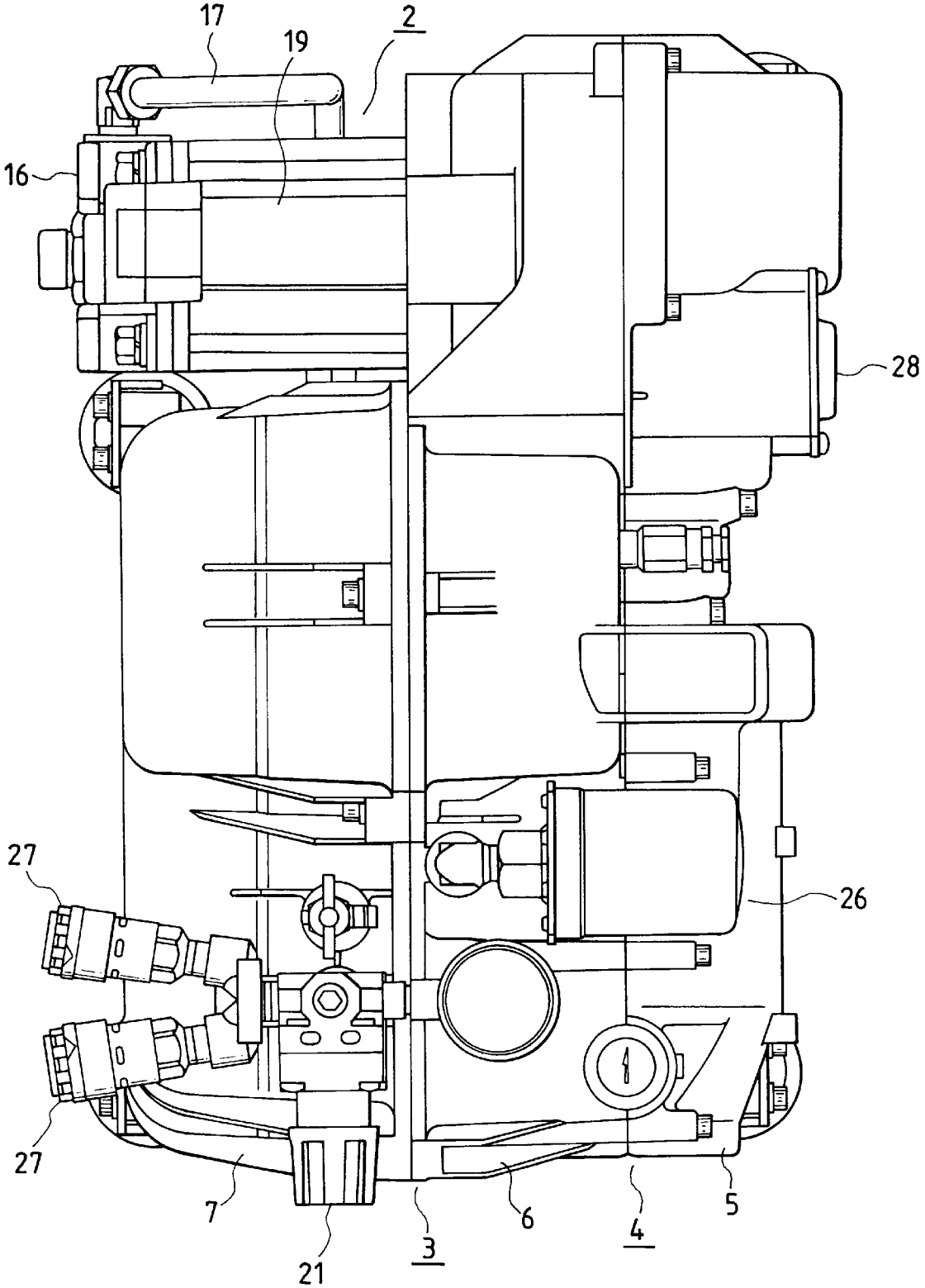
FIG. 4 is a front view showing the portable compressor shown in FIG. 1.

When the piston 14 slides downward, the inside space of the cylinder 15 is kept at negative pressures. An intake valve (not shown), provided in a cylinder head 16, opens in response to the negative pressures in the cylinder 15. Air is introduced into the cylinder 15 via an air intake port 28, a crank chamber 18, a pipe 19, and the cylinder head 16. The intake valve is closed when the piston 14 slides upward. The air confined in the cylinder 15 is compressed by the piston 14 moving upward. An exhaust valve (not shown), provided in the cylinder head 16, opens when the pressure of the compression air reaches a predetermined level. The compression air is discharged from the cylinder 15 via the cylinder head 16, the pipe 17 etc. and stored in the air tank 3. The cylinder head 16 has air flow passages independent from each other and dedicated to the intake and exhaust operations, respectively. The compression air stored in the air tank 3 is supplied to a pneumatically operated machine (not shown), such as a nail driver, via the pressure-reducing valve 21 and a socket 27 shown in FIG. 4.

A housing 4 accommodates and supports the driving mechanism including the motor 1 and the power transmitting mechanism. The power transmitting mechanism comprises the pinion 8, the gear 9, the drive shaft 10, the coil spring 11, and the output shaft 12. The housing 4 is a two-piece housing unit separable into a first housing 5 and a second housing 6, when divided along a plane including the axes of the motor 1, the drive shaft 10, and the output shaft 12. The first and second housings 5 and 6 cooperatively form the crank chamber 18 of a compression mechanism 2. The cylinder 15 extends upward from the second housing 6 with an axis normal to the output shaft 12.

A recessed portion 50 is formed on the second housing 6 and extends entirely along the upper (outer) surface thereof, except for the region occupied by the compression mechanism 2 including the cylinder 15. A third housing 7 has a hollow inside space 7*b* with a flanged periphery 7*a* coupled with a flanged periphery 6*a* of the second housing 6 (i.e., the recessed portion 50). The second housing 6 and the third housing 7 are airtightly fastened by means of bolts 22 along their flanged peripheries 6*a* and 7*a*, so as to form the air tank 3. More specifically, a ring groove is formed along the flanged peripheries 6*a* and 7*a* of the second housing 6 and the third housing 7. A packing 23, having a sufficient shrink range, is inserted in this ring groove to prevent the compression air from leaking out of the air tank 3. The first housing 5, the second housing 6, and the third housing 7 are aluminum die-casts or similar mold products. The compression mechanism 2 is adjacent to the third housing 7. The top level of the compression mechanism 2 is substantially the same as that of the third housing 7.

As described above, the preferable embodiment of the present invention discloses the portable compressor comprising the motor 1 for generating a rotational force, the compression mechanism 2 including a member (i.e., piston 14) driven by the rotational force transmitted from the motor 1 via the power transmitting mechanism 8~12, and the air tank 3 storing compression air produced by the compression mechanism 2. The motor 1 and the power transmitting mechanism 8~12 are accommodated and supported in a two-piece housing unit 4 separable into first and second housings 5 and 6, and the air tank 3 is defined by an outer surface of the second housing 6 and an inside surface of a third housing 7 provided outside the second housing 6.

The first to third housings 5~7 are mold or cast products. The compression mechanism 2 is located adjacent to the third housing 7, and the top level of the compression mechanism 2 is substantially the same as that of the third housing 7. The groove is formed along flanged peripheries 6*a* and 7*a* of the second and third housings 6 and 7. The seal member 23 is inserted into the groove. The second and third housings 6 and 7 are airtightly fixed via the seal member 23 by means of fastening members (i.e., volts 22). The second housing 6 has a recessed portion 50 on the outer surface thereof, and the third housing 7 is provided on the recessed portion 50 of said second housing 6.

The two-piece housing unit 4 is separable into the first and second housings 5 and 6 along the plane including the axes of the motor 1, the drive shaft 10, and the output shaft 12. Thus, the motor 1 and the power transmitting mechanism 8~12 are easily installed and held accurately at predetermined positions in the second housing 6. The assembling of the motor 1 and the power transmitting mechanism 8~12 is easily accomplished by uniting the first and second housings 5 and 6. Two locating snap rings 24, inserted in the circular grooves formed on the first and second housings 5 and 6, accurately position the drive shaft 10 and the output shaft 12. Furthermore, each locating snap ring 24 acts as a sealing member for accommodating the coil spring 11 in a closed chamber 52. Thus, it becomes possible to prevent the iron powder, when generated from the coil spring 11, from entering in the crank chamber 18 and a gear chamber 25.

As described above, the air tank 3 is constituted by two-piece housings, i.e., by the second housing 6 and the third housing 7. The second housing 6 is also part of the two-piece housing unit 4. In other words, this arrangement is effective to reduce the total number of parts constituting the air tank 3. Furthermore, the gap between the second housing 6 and the third housing 7 is airtightly sealed by the packing 23. The second housing 6 and the third housing 7 are securely fastened by the bolts 22. This arrangement requires no welding operation and no mounting parts for fixing the air tank to the housing.

The compression mechanism 2 overhangs from the second housing 6, leaving a space available for locating something. According to the above-described embodiment, this space is used for locating the air tank 3. In other words, the compressor becomes compact.

Figure 5:
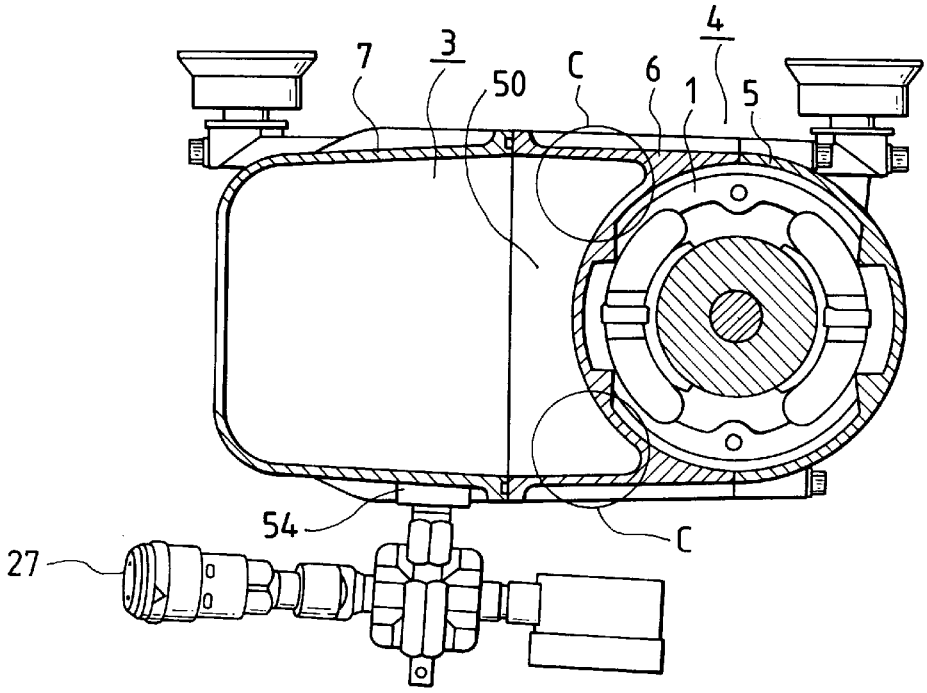
FIG. 5 is a cross-sectional view taken along a line B—B shown in FIG. 1.

The second housing 6, as shown in FIG. 1, has the recessed portion 50 inevitably formed on its outer surface due to formation of the bearing chamber or the like. As shown in FIG. 5, dead spaces "C" are inevitably formed at the corners of the recessed portion 50 when the wall of the second housing 6 is configured into a round shape so as to accommodate or support the cylindrical member, such as the motor 1. By utilizing this recessed portion 50 (i.e., dead space) for the air tank 3, it becomes possible to substantially increase the capacity of the air tank 3.

Furthermore, it is possible to form the mounting portions 54 integrally on the outer surface of the air tank 3 in the manufacturing process for molding the housings 6 and 7. This makes it possible to eliminate any welding operation and mounting parts for fixing the auxiliary devices, such as the pressure-reducing valve 21 and the pressure switch 26.

Moreover, the auxiliary devices are disposed in a stepped portion 30 of the housing unit 4 formed due to an offset arrangement for locating the pinion 8 and the gear 9 in the power transmitting mechanism. This arrangement is advantageous in that the compressor becomes compact.

Figure 6:
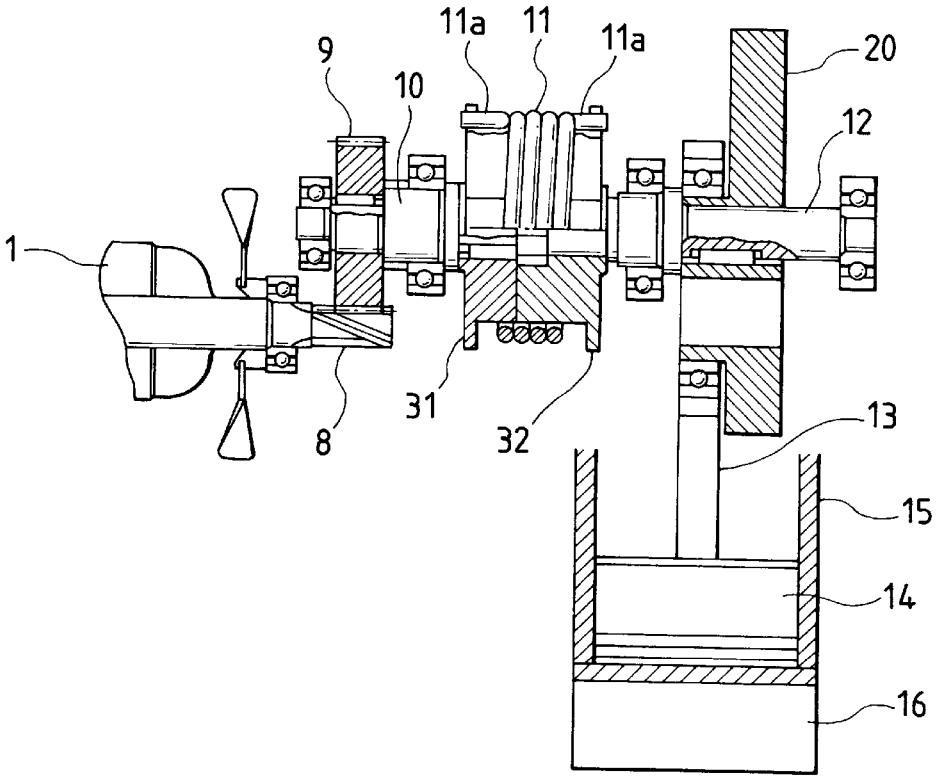
FIG. 6 is a view exclusively showing a driving mechanism of the portable compressor shown in FIG. 1.

FIG. 6 shows only the driving mechanism extending from the motor 1 via the power transmitting mechanism 8~12 to the piston 14. The drive shaft 10, equipped with the gear 9, is securely fixed to a spring holder 31 at the other end. The output shaft 12, connected to a flywheel 20 at one end, is securely fixed to another spring holder 32 at the other end. The spring holder 32 faces to the spring holder 31 and is rotatable independently. The spring holders 31 and 32 are connected via the coil spring 11. Both ends 11*a* of the coil spring 11 extend parallel to the axes of the drive shaft 10 and the output shaft 12. With this arrangement, it becomes possible to absorb the shock caused by a sudden change in the rotation of the drive shaft 10 and/or the output shaft 12.

As is well known, the compressor is subjected to load variations which cause the noises. However, connecting the drive shaft 10 to the output shaft 12 via the coil spring 11 is effective to reduce the natural frequency of the compressor axle arrangement below the load variation frequency. Thus, the noises can be suppressed. The compressor can be downsized.

Figure 7:
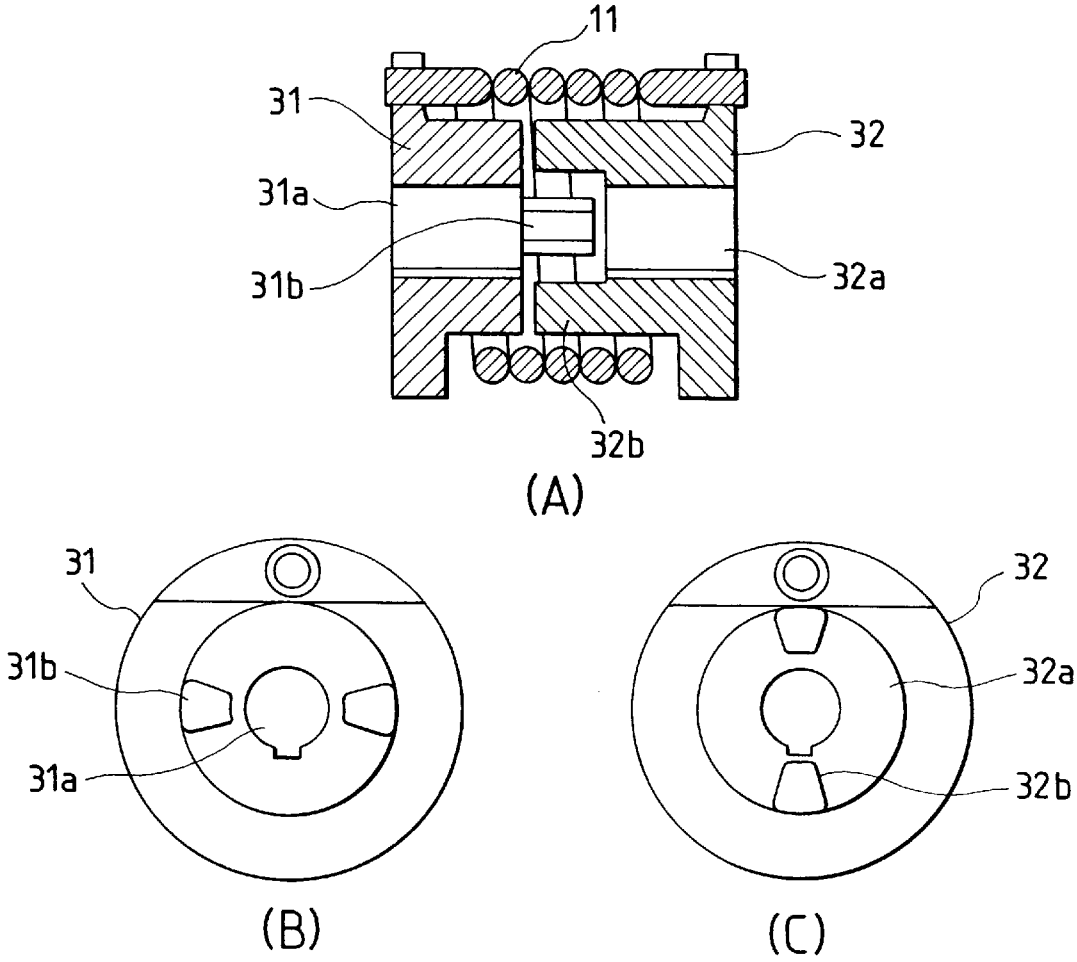
FIG. 7 is a composite view showing a modified arrangement of a coil spring and spring holders employed in the portable compressor shown in FIG. 1, including a cross-sectional view (A) showing a relationship between the coil spring and the spring holders and side views (B) and (C) showing the spring holders from inside thereof.
Figure 8:
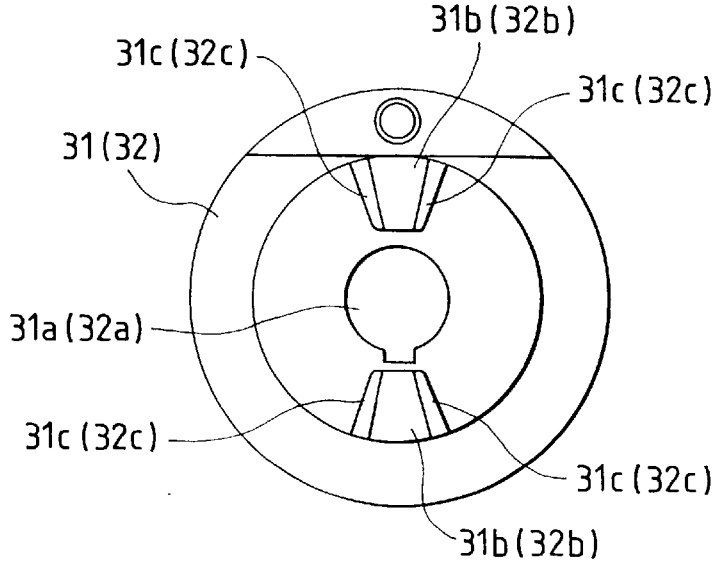
FIG. 8 is a side view showing another modified arrangement of the coil spring and the spring holders.

FIG. 7 shows another example of the spring holders 31 and 32. The spring holder 31 has a key-way equipped bore 31*a* and two opposed projections 31*b* protruding inward from the cylindrical wall of the bore 31*a*. Similarly, the spring holder 32 has a key-way equipped bore 32*a* and two opposed projections 32*b* protruding inward from the cylindrical wall of the bore 32*a*. When an angular deviation between the drive shaft 10 and the output shaft 12 exceeds 60°, the projections 31*b* collide with the projections 32*b* to limit the angular deviation between the drive shaft 10 and the output shaft 12. To suppress collision noises, it is preferable to cover the projection 31*b* (32*b*) by a rubber 31*c* (32*c*) as shown in FIG. 8.

Figure 9:
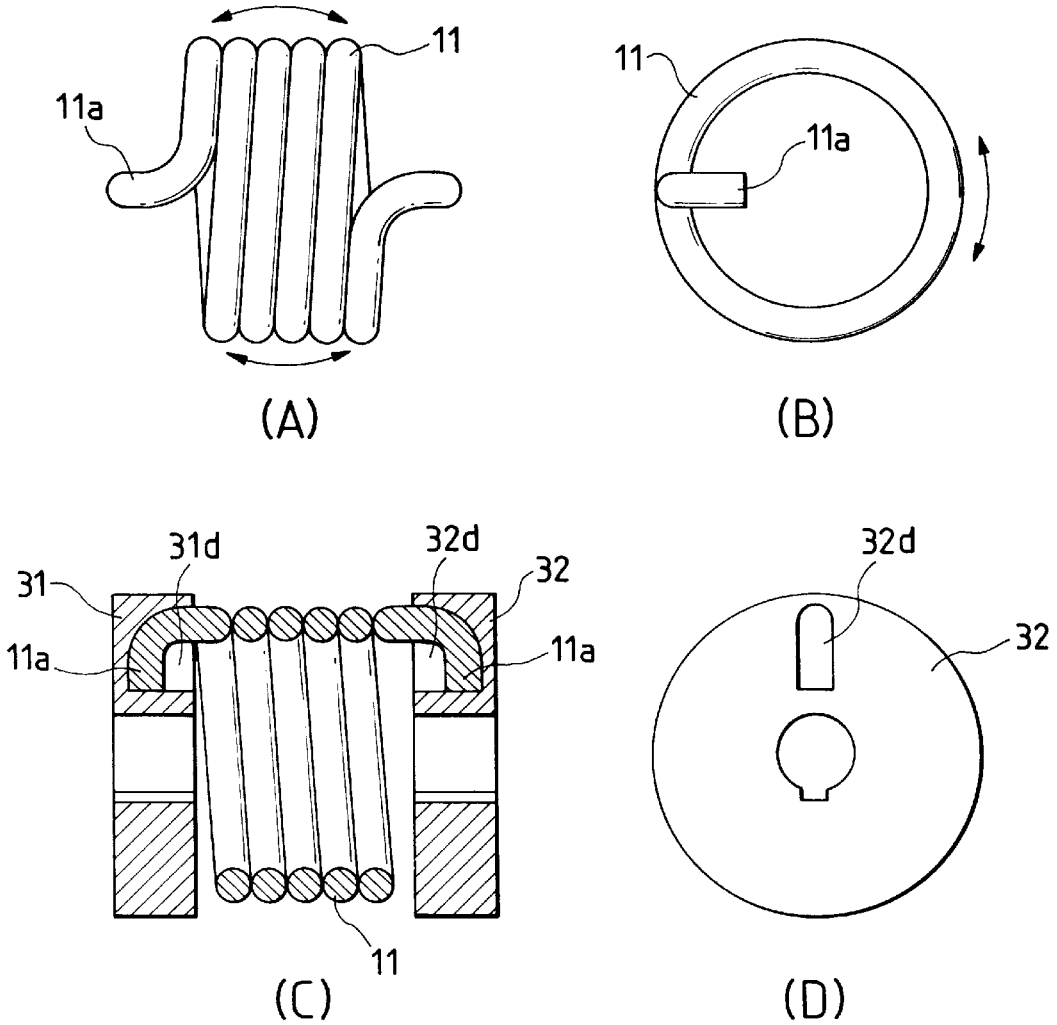
FIG. 9 is a composite view showing another modified arrangement of the coil spring and the spring holders, including a front view (A) and a side view (B) respectively showing the coil spring, a cross-sectional view (C) showing a relationship between the coil spring and the spring holders, and a side view (D) showing the spring holder from inside thereof.

FIG. 9 shows another example of the spring holders 31 and 32. Each spring holder 31 (32) has a fixing hole 31*d* (32*d*). The end 11*a* of the spring coil 11 is bent radially inward and inserted into the fixing hole 31*d* (32*d*). Thus, the coil spring 11 can be tightly and stably fixed to the spring holders 31 and 32.

Figure 10:
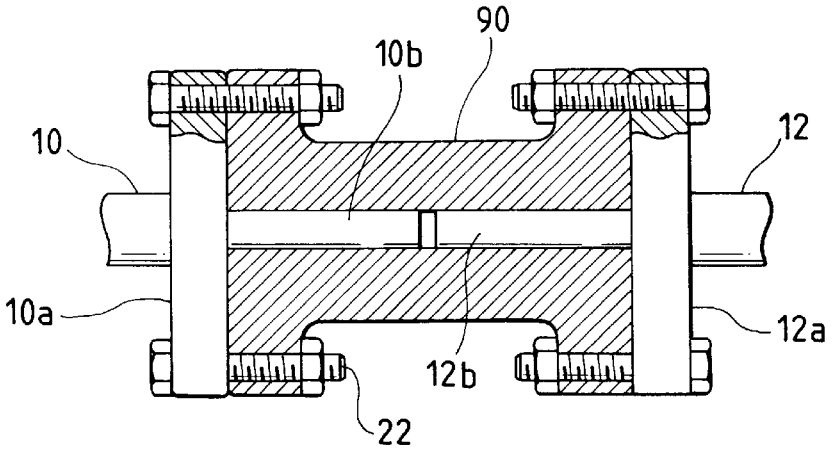
FIG. 10 is a cross-sectional view showing another elastic member employed in the portable compressor shown in FIG. 1.

FIG. 10 shows another elastic member replaceable for the coil spring 11. Damper holders 10*a* and 12*a* are attached to the ends of the drive shaft 10 and the output shaft 12, respectively. A rubber damper 90 is provided between the damper holders 10*a* and 12*a*. Guides members 10*b* and 12*b* extend inward from the damper holders 10*a* and 12*a* and are inserted into a central bore of the rubber damper 90.

This invention may be embodied in several forms without departing from the spirit of essential characteristics thereof. The present embodiment as described is therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A portable compressor comprising:

a motor for generating a rotational force;

a compression mechanism including a member driven by the rotational force transmitted from said motor via a power transmitting mechanism; and an air tank storing compression air produced by said compression mechanism;

wherein said motor and said power transmitting mechanism are accommodated and supported in a two-piece housing unit separable into first and second housings; and said air tank is defined by an outer surface of said second housing and an inside surface of a third housing provided on said second housing.

2. The portable compressor in accordance with claim 1, wherein said first to third housings are mold or cast products.

3. The portable compressor in accordance with claim 1, wherein said compression mechanism is located adjacent to said third housing, and a top level of said compression mechanism is substantially the same as that of said third housing.

4. The portable compressor in accordance with claim 1, wherein a groove is formed along flanged peripheries of said second and third housings, a seal member is inserted into said groove, and said second and third housings are airtightly fixed via said seal member by means of fastening members.

5. The portable compressor in accordance with claim 1, wherein said second housing has a recessed portion on the outer surface thereof, and said third housing is provided on said recessed portion of said second housing.

6. The portable compressor in accordance with claim 1, wherein said two-piece housing unit is separable along a plane including the axes of said motor and said a power transmitting mechanism.

7. The portable compressor in accordance with claim 1, wherein said power transmitting mechanism includes a drive shaft and an output shaft connected by an elastic element.

8. The portable compressor in accordance with claim 7, wherein a plurality of locating snap rings are provided for positioning said shafts of said power transmitting mechanism in a closed chamber accommodating said elastic member.

9. The portable compressor in accordance with claim 7, wherein said elastic element is held by holders having a restricting mechanism for limiting an angular deviation between said drive shaft and said output shaft.

10. The portable compressor in accordance with claim 1, wherein said compression mechanism overhangs from said second housing, leaving a space available for locating said air tank.

11. The portable compressor in accordance with claim 1, wherein a mounting portion is integrally formed on an outer surface of said air tank for fixing auxiliary devices of the compressor.

12. The portable compressor in accordance with claim 1, wherein auxiliary devices are disposed in a stepped portion of said two-piece housing unit formed due to an offset arrangement for locating gears in said power transmitting mechanism.

* * * * *